United States Patent [19]

Labrijn

[11] Patent Number: 4,918,819

[45] Date of Patent: Apr. 24, 1990

[54] ELECTRIC SHAVING APPARATUS

[75] Inventor: Hans Labrijn, Drachten, Netherlands

[73] Assignee: U.S. Philips Corp., New York, N.Y.

[21] Appl. No.: 249,615

[22] Filed: Sep. 26, 1988

[30] Foreign Application Priority Data

Oct. 5, 1987 [NL] Netherlands ..... 8702363

[51] Int. Cl.[5] ..... B26B 19/38

[52] U.S. Cl. ..... 30/43; 30/43.6; 30/DIG. 1; 30/DIG. 2

[58] Field of Search ..... 30/43, 43.5, 43.6, 43.8, 30/43.9, 43.91, 43.92, 34.1, DIG. 1, DIG. 2

[56] References Cited

U.S. PATENT DOCUMENTS 3,568,313 3/1971 Hutter ..... 30/43.6

3,675,324 7/1972 Yamada et al. ..... 30/DIG. 1

4,631,825 12/1986 Kuriyama et al. ..... 30/43.91 X

*Primary Examiner*—Frank T. Yost

*Assistant Examiner*—Rinaldi Rada

*Attorney, Agent, or Firm*—Ernestine C. Bartlett

[57] ABSTRACT

An electric shaving apparatus comprises at least one drivable shaving member, a first housing section which accommodates the drive mechanism for the shaving member and a detachable second housing section which accommodates an electric power source, for example a rechargeable battery, a switching device, which comprises an actuating member, being arranged in an electric circuit which also includes the drive mechanism and the power source and a contact member. The actuating member is arranged on a wall of the first housing section and is detachably coupled to the contact member in the second housing section by mechanical means.

7 Claims, 2 Drawing Sheets

ELECTRIC SHAVING APPARATUS

FIELD OF THE INVENTION

The invention relates to an electric shaving apparatus comprising at least one drivable shaving member; a first housing section which accommodates the drive mechanism for the shaving member; and a detachable second housing section which accommodates an electric power source, for example a rechargeable battery, a switching device which comprises an actuating member, and a contact member, arranged in an electric circuit which also includes the drive mechanism and the power source.

BACKGROUND OF THE INVENTION

Such a shaving apparatus is known, for example from JP-GM 61-205472, the actuating member and the contact member being accommodated in the first housing section. The contact member comprises movable conductive contact elements, also see for example U.S. Pat. No. 4,631,825, which are not shielded so that the contact elements may become soiled by shaving particles, which may impair the correct operation of the switching device after some time. Moreover, if the shaver may be cleaned with water there is a risk of short-circuit and corrosion of the contact member. Obviously it is possible to shield the switching device from the remainder of the space in the first housing section, but this makes the switching device more expensive and it requires more space, which is in conflict with a more compact construction of the shaver.

SUMMARY OF THE INVENTION

An object of the invention to mitigate these drawbacks and to this end the invention is characterized in that the actuating member is arranged on a wall of the first housing section and is detachably coupled to the contact member in the second housing section by mechanical means.

Special embodiments are defined in the appended subsidiary claims and include for example, such an apparatus wherein:

(a) the mechanical means comprise a crank shaft and a connecting rod, the crank shaft being rotatably supported in a wall of the first housing section, a crank web at the outer side being provided with a connection pin and the crank rod being coupled to a crank web at the inner side of the wall; and/or (b) a slidable actuating member is arranged on the wall of the first housing section at the outer side and is coupled to a crank pin; and/or (c) the actuating member comprises a latching member by means of which the actuating member can be latched in different positions; and/or (d) the contact member in the second housing section is provided with a resilient element which also constitutes a pressure element for a seal for an opening in the wall of the second housing section, which opening serves for the passage of the mechanical means.

BRIEF DESCRIPTION OF THE DRAWINGS

An embodiment of the invention will now be described in more detail, by way of example, with reference to the accompanying Figures.

DETAILED DESCRIPTION OF THE PREFERRED EMBODIMENTS

Figure 1:
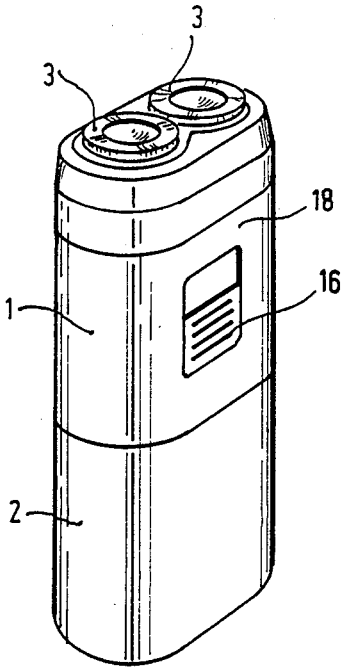
FIG. 1 is a perspective view of a shaving apparatus in accordance with the invention.
Figure 2:
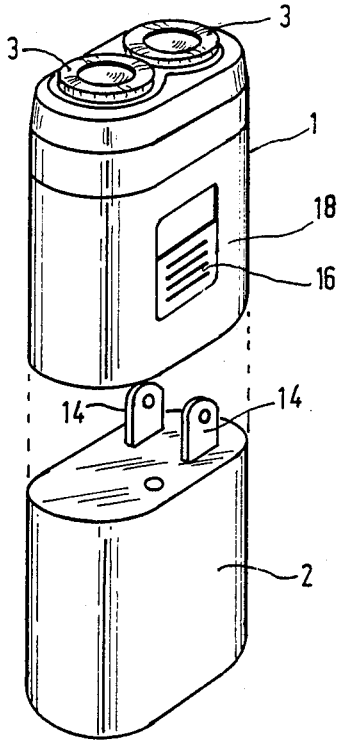
FIG. 2 shows the shaver of FIG. 1 with the housing sections taken apart.
Figure 3:
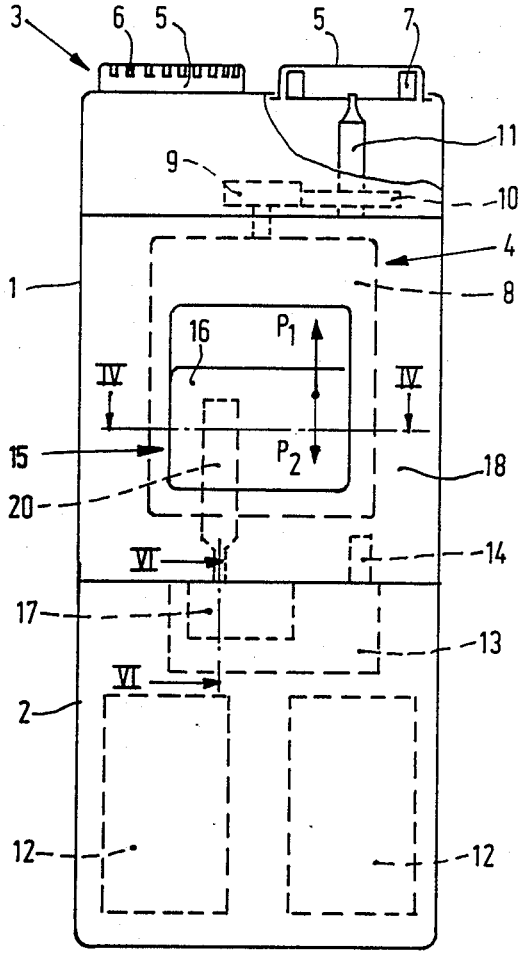
FIG. 3 is a diagrammatic view of the shaving apparatus shown in FIGS. 1 and 2.

The electric shaving apparatus is shown in FIGS. 1 to 3, and comprises housing sections 1 and 2 which are detachable from each other. The first housing section 1 is provided with two shaving heads 3 and a drive mechanism 4. A shaving head 3 comprises a shear plate 5 formed with hair entry apertures 7 and a rotatable shaving member 7. The drive mechanism 4 comprises an electric motor 8 which is coupled to a shaving member 7 via the gearwheels 9 and 10 and a shaft 11.

The second housing section 2 accommodates the electric power source for the motor, in the present case two rechargeable batteries 12. Moreover, this housing section accommodates an electric charging unit 13. The housing section 2 can be plugged into a wall socket via the contact pins 14 to charge the batteries. When the housing section 1 is mounted onto the housing section 2 the electrical connection between the two housing sections is established by means of the same contact pins 14. A switching device 15, comprising an actuating member 16 and a contact member 17, is arranged in the electric circuit which also includes the motor 8 and the batteries 12.

Figure 4:
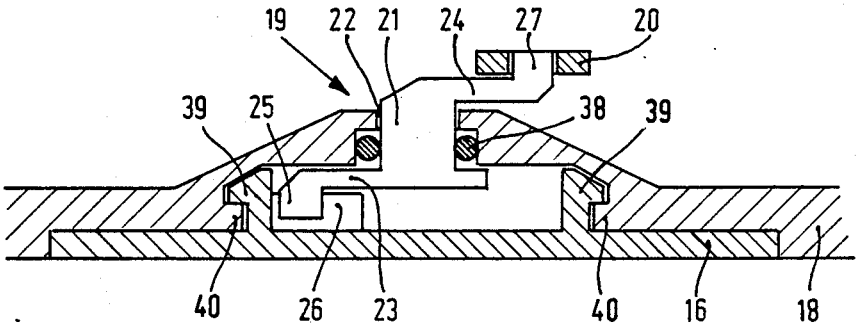
FIG. 4 is a sectional view taken on the line IV—IV in FIG. 3.
Figure 5:
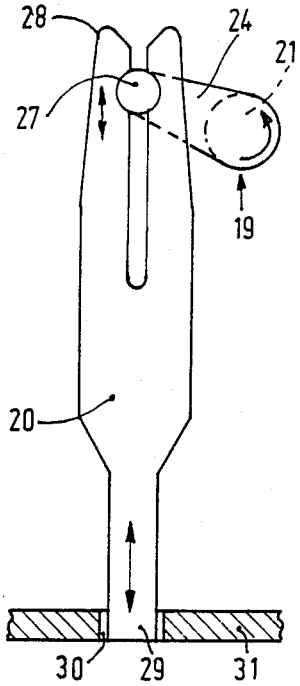
FIG. 5 shows the mechanical means for transmitting the movement of the actuating member of the switch to the contact member.
Figure 6:
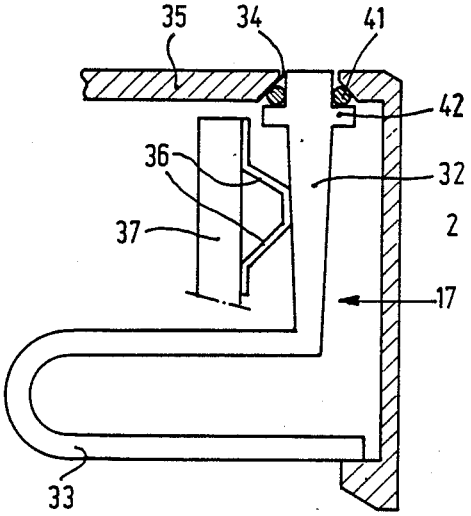
FIG. 6 is a partly sectional view taken on the line VI—VI in FIG. 3.

The actuating member 16 is constructed as a slide which is movable on the wall 18 of the housing section 1 in the directions indicated by the arrows $P_1$ and $P_2$. With the aid of mechanical means the slide 16 is detachably coupled to the contact member 17 in the second housing section 2 (see also FIGS. 4 to 6). These mechanical means comprise a crank shaft 19 and a connecting rod 20. The crank shaft 19 is rotatably supported in an opening 22 in the housing wall 18 by means of the spindle 21, so that one crank web 23 is situated at the outer side and one crank web 24 at the inner side.

The crank web 23 comprises the crank pin 25 which engages against the ridge 26 of the actuating member 16. At its end the crank web 24 carries a crank pin 27 on which the forked end portion 28 of the connecting rod 20 is clamped.

When the actuating member 16 is moved upwards in the direction indicated by the arrow $P_1$ the crank pin 25 is moved by the ridge 26, so that the crank shaft 19 is rotated to move the connecting rod 20 downwards in the direction indicated by the arrow $P_2$. The end portion 29 of the connecting rod 20 engages in the opening 30 in the bottom wall 31 of the housing section 1.

A contact member 17 comprising an arm 32 and a U-shaped resilient element 33 is situated in the housing section 2. When the connecting rod 20 moves downwards the end portion 29 passes through the opening 30 in the housing section 1 and the opening 34 in the wall 35 of the housing section 2 and the arm 32 is urged downwardly against the action of the resilient element 33. The arm 32 comprises conductive contact elements 36 which in known manner cooperate with contact faces on a printed circuit board 37, to switch on the motor 8. This p.c. board may also carry the parts for the electric charging unit 13, enabling a very compact construction to be obtained. A second ridge on the slide 16, which second ridge is not shown but is similar to the ridge 26 and is situated at the other side of the crank pin 25, ensures that if the slide is subsequently moved downwards in the direction indicated by the arrow $P_2$, the crank pin 25 and hence the connecting rod 20 are moved upwards, to switch off the motor 8.

In the present embodiment the housing wall 18 need only be formed with a circular opening 22, which can be sealed simply in a dust tight and water tight manner by means of a sealing ring 38.

The actuating member 16 comprises hook-shaped portions 39 which engage behind wall portions 40 of the housing wall 18.

The opening 34 can also be sealed by means of a sealing ring 41 which is pressed in position by means of a flange 42 on the arm 32 under the influence of the resilient element 33.

In the embodiment described in the foregoing the contact member 17 of the switching device 15 is accommodated in the housing section 2 which can be sealed effectively against shaving particles, moisture and the like, which substantially precludes the risk of soiling. The electrically conductive components of the switching device can be accommodated on or near the pc board 37 for the charging unit 13, thus enabling the switching device to be assembled efficiently. The switching device can be constructed simply in such a way that the connection between the rechargeable batteries 12 and the charging unit is established at the same time that the motor is switched off.

In order to prevent the actuating member 16 from being moved under the influence of the spring force exerted by the resilient element 33 while the motor is energized on, the actuating member may be provided with a latching mechanism, which is known per se and which is described in, for example, U.S. Pat. No. 4,631,825. The housing sections 1 and 2 can also be secured to one another in their assembled condition by conventional means, for example by means of a snap connection or a threaded bolt in order to prevent these housing sections from being urged apart by the spring force of the resilient element 33.

What is claimed is:

1. An electric shaving apparatus comprising at least one drivable shaving member, a first housing section which accommodates the drive mechanism for the shaving member and a detachable second housing section which accommodates an electric power source; and a switching device which comprises an actuating member and a contact member, said switching device being arranged in an electric circuit which also includes the drive mechanism and the power source, wherein the actuating member is arranged on a wall of the first housing section and is detachably coupled to the contact member in the second housing section by mechanical means comprising a crank shaft having crank webs and a connecting rod, the crank shaft being rotatably supported in said wall of the first housing section, a crank web at the outer side being provided with a crank pin and the connecting rod being coupled to a crank web at the inner side of said wall.

2. An electric shaving apparatus as claimed in claim 1, wherein the actuating member is constructed as a slide arranged on the wall of the first housing section at the outer side and is coupled to the crank pin.

3. An electric shaving apparatus as claimed in claim 2 wherein the actuating member comprises a second ridge which insures that downward movement of said slidable actuating member moves the connecting rod upwards to switch the motor off.

4. An electric shaving apparatus as claimed in claim 1, wherein the contact member in the second housing section is provided with a resilient element which also constitutes a pressure element for a seal for an opening in the wall of the second housing section, which opening serves for the passage of the mechanical means.

5. An electric shaving apparatus as claimed in claim 1 wherein said crank shaft has first and second crank webs attached thereto and is rotatably supported in a wall of the first housing section by a spindle, the first crank web comprising a crank pin which engages against a ridge on the actuating member, the second crank web comprising a crank pin to which the connecting rod is attached.

6. An electric shaving apparatus as claimed in claim 5 wherein the actuating member is constructed as a slide and the contact member is effectively sealed in the second housing section.

7. An electric shaving apparatus as claimed in claim 1 wherein said second housing section comprises a charging unit, electrically conductive components of the switching device and charging unit being accommodated on a printed circuit board.

* * * * *